US005853054A

United States Patent [19]

McGarian et al.

[11] Patent Number: 5,853,054

[45] Date of Patent: Dec. 29, 1998

[54] 2-STAGE UNDERREAMER

[75] Inventors: Bruce McGarian, Aberdeen; Richard Alvin Armell, Angus, both of Great Britain

[73] Assignee: Smith International, Inc., Houston, Tex.

[21] Appl. No.: 836,534

[22] PCT Filed: Oct. 31, 1995

[86] PCT No.: PCT/GB95/02540

§ 371 Date: Jul. 22, 1997

§ 102(e) Date: Jul. 22, 1997

[87] PCT Pub. No.: WO96/13648

PCT Pub. Date: May 9, 1996

[30] Foreign Application Priority Data

Oct. 31, 1994 [GB] United Kingdom ..... 9422022
Mar. 17, 1995 [GB] United Kingdom ..... 9505430

[51] Int. Cl.[6] ..... E21B 7/28

[52] U.S. Cl. ..... 175/267; 175/279; 175/285; 175/286; 175/406; 175/434; 175/435

[58] Field of Search ..... 175/267, 274, 175/279, 284–286, 406, 434, 435

[56] References Cited

U.S. PATENT DOCUMENTS

| | | | |
|---|---|---|---|
| 1,993,182 | 3/1935 | Santiago . | |
| 1,998,804 | 4/1935 | Flury et al. . | |
| 2,743,906 | 5/1956 | Coyle . | |
| 2,822,150 | 2/1958 | Muse et al. . | |
| 4,190,126 | 2/1980 | Kabashima . | |
| 4,618,009 | 10/1986 | Carter et al. . | |
| 4,809,793 | 3/1989 | Hailey . | |
| 4,842,082 | 6/1989 | Springer | 175/325.2 |
| 5,014,780 | 5/1991 | Skipper . | |
| 5,036,921 | 8/1991 | Pittard et al. . | |
| 5,074,355 | 12/1991 | Lennon . | |
| 5,090,480 | 2/1992 | Pittard et al. | 175/267 X |
| 5,174,374 | 12/1992 | Hailey . | |
| 5,242,017 | 9/1993 | Hailey | 175/267 X |

FOREIGN PATENT DOCUMENTS

| | | |
|---|---|---|
| 0 391683 A1 | 10/1990 | European Pat. Off. . |
| 1199031 | 7/1970 | United Kingdom . |
| 2262711 | 6/1993 | United Kingdom . |

*Primary Examiner*—Roger Schoeppel
*Attorney, Agent, or Firm*—Watson Cole Grindle Watson, P.L.L.C.

[57] ABSTRACT

A 2-stage underreamer for use in a subterranean wellbore includes a unitary body having upper and lower blades mounted in slots formed perpendicular to each other in the body. Separate upper and lower piston assemblies are provided for driving the blades respectively from a storage configuration in which they are located substantially completely within the slots to a use position. The blades each include a steel arm having mounted thereon a base of tungsten nickel cobalt matrix in which diamond and/or tungsten carbide inserts are provided. A signal is given to the surface that the blades are in their extended position by changing the mud.

15 Claims, 5 Drawing Sheets

2-STAGE UNDERREAMER

BACKGROUND OF THE INVENTION

This invention relates to a 2-stage underreamer, that is to say a reaming tool for use in a subterranean well bore, the tool having axially spaced apart first and second reaming stages. 2-stage underreamers have been proposed in which the bodies of the upper and lower stages are releasably secured to each other by way of a threaded interconnection. Whilst such an arrangement considerably assists the manufacture of the tools it suffers from the disadvantage that very close manufacturing tolerances are necessary if, when the upper and lower body parts are screwed together, the blades on the upper and lower parts are to end up at exactly the correct angular position relative to each other. Further, the presence of a screw-threaded joint between the upper and lower stages of the tool reduces the strength of the body as compared with the strength of a unitary body.

SUMMARY OF THE INVENTION

Accordingly, a first aspect of the present invention provides a 2-stage underreamer comprising an upper pair of reaming blades mounted in a slot or pocket in a body and a lower pair of reaming blades mounted in a slot or pocket in the body, wherein the body is unitary.

In the preferred embodiment of the present invention the blades of the upper stage are hingedly mounted on the body and are movable from a retracted storage position to an extended use position by movement in respective first and second mutually parallel planes. Similarly, the lower blades are hingedly mounted on the body and are movable from a retracted storage position to an extended use position in third and fourth respective mutually parallel planes. In the preferred embodiment the third and fourth planes are perpendicular to the first and second planes.

In the preferred embodiment of the invention power means are provided for moving the blades from their respective retracted to their respective extended positions. Such power means preferably comprises a hydraulically actuated piston which exerts a force on a cam surface of its associated blade to cam the blades from the retracted to the extended positions. Preferably, spring biasing means are provided for biasing the blades from their extended towards their retracted position so that if the power means ceases to act on the cam surfaces of the blades the blades will be retracted under the influence of the spring biasing means.

Preferably, a single upper blade power means is provided for acting simultaneously on both upper blades and a single lower blade power means is provided for acting simultaneously on the lower blades.

In a particularly preferred embodiment of the invention the power means comprises a piston having a first piston portion having a circular face on which hydraulic fluid acts to generate a force and a second piston portion which is annular and upon which hydraulic fluid acts to create force reinforcing that produced by the hydraulic fluid acting on the first piston portion. To this end, in the preferred embodiment of the invention the first piston portion is connected to the second piston portion by a rod which passes through an annular member which sealingly engages the rod and a bore provided in the body and separates a fluid chamber which is bounded on one side by the second piston portion from a zone of the bore of the body which is vented to the exterior of the body.

Whilst the above described power means is particularly suitable for use in the 2-stage reamer of the present invention, the power means may be more generally applicable and may be utilized in other apparatus requiring generation of a force by application of a hydraulic pressure.

Preferably, means are provided for indicating when at least one of the sets of blades has moved from its retracted to its extended position. Such means preferably comprises a flow passage through the tool for hydraulic fluid the cross-sectional area of which changes when one of the sets of blades moves from its retracted to its extended position, thereby providing an indication by way of the fluid flow rate through the tool that the blades have moved from their retracted to their extended position.

BRIEF DESCRIPTION OF THE DRAWINGS

The invention will be better understood from the following description of a preferred embodiment thereof, given by way of example only, reference being had to the accompanying drawings wherein.

DETAILED DESCRIPTION OF THE INVENTION

Figure 1:
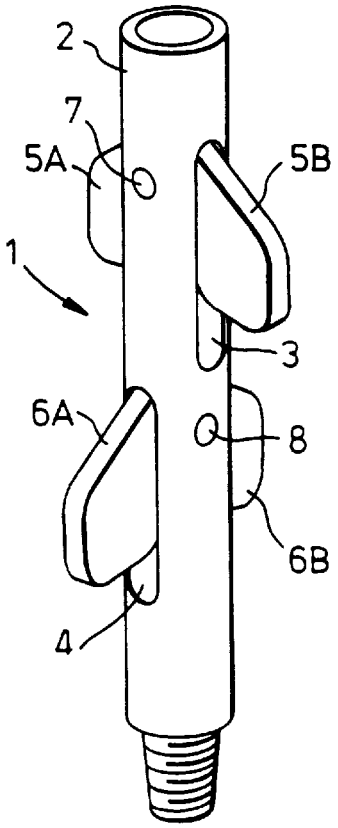
FIG. 1 is a pictorial representation showing the general configuration of an embodiment of the present invention with the reaming blades in the extended position.

Referring firstly to FIG. 1 the general configuration of a 2-stage reamer 1 in accordance with the present invention is illustrated. The reamer 1 comprises a unitary body 2 in which is formed an upper slot 3 and a lower slot 4. The slots extend completely through the body to provide respective upper and lower pockets. A pair of upper blades 5A and 5B are mounted in the slot 3 and a pair of lower blades 6A and 6B are mounted in the lower slot 4. The blades 5A,5B,6A,6B are pivotally connected to the body by means of pivot pins 7,8. The central longitudinal planes of the slots 3,4 are mutually perpendicular to each other.

A practical embodiment of the invention is illustrated in FIGS. 2A–2D, 3 and 4.

Figure 2A:
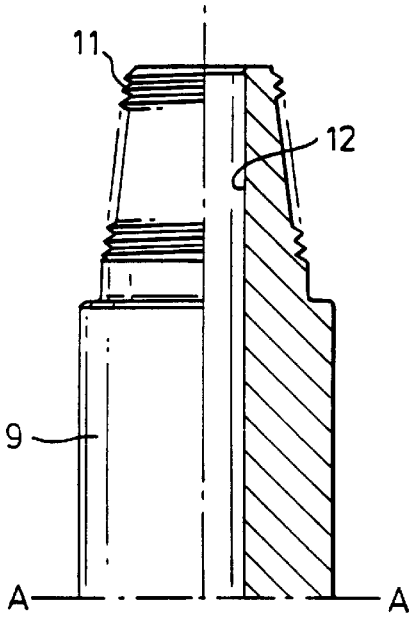
FIG. 2A illustrates a portion of a preferred embodiment of the present invention from the upper end thereof to a plane A—A.
Figure 2B:
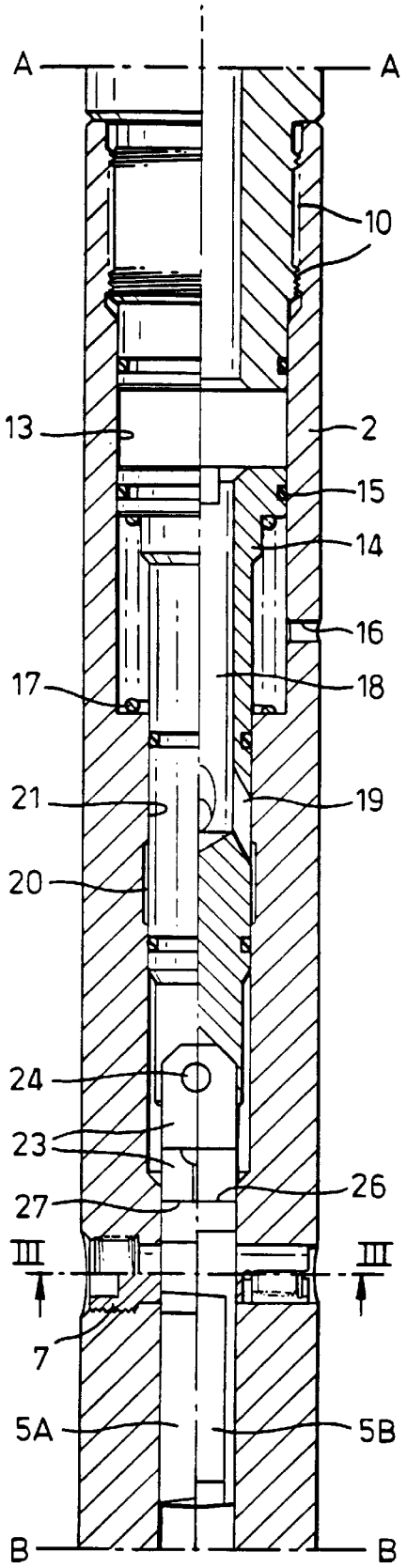
FIG. 2B illustrates a portion of an embodiment of the invention from the plane A—A of FIG. 2A to the plane B—B.

Referring firstly to FIGS. 2A and 2B an adapter 9 is screw threadedly engaged with a screw-thread 10 provided on the upper end of the body 2. The adapter 9 has a conventional tapered connecting thread 11 at the upper end thereof for engagement with tools or a drill string to which the 2-stage underreamer is connected. In a typical application the 2-stage underreamer will be connected via suitable subs to a downhole motor to provide for rotation of the 2-stage underreamer to effect reaming of a body located within a well bore.

The adapter 9 includes a through bore 12 for communicating fluid to the interior of the body 10.

Immediately below the adapter 9 the body 2 defines a cylinder portion 13 in which an upper piston 14 is slidably mounted. A seal 15 provided on the piston 14 sealingly engages the cylinder 13. The zone of the cylinder 13 below the seal 15 is vented to the exterior of the tool via a vent passage 16. A spring 17 biases the piston 14 upwardly as viewed in FIG. 2B.

The piston 14 includes a central passage 18 which communicates at the upper end of the piston with the space above the piston and, at the lower end of the passage 18, with a multiplicity of slots 19 which connect the passage 18 to the exterior of the piston. In the absence of fluid pressure within the cylinder 13 the piston 14 will adopt the position illustrated in FIG. 2B under the influence of the spring 17. In this position the slots 19 overlap slightly with an annular groove 20 formed in the bore 21 of the body 2 thereat. The groove 20 in turn communicates via generally radially extending passages (not shown) with by-pass passages 22 provided for communicating fluid flow past the blades 5A,5B. As the piston 14 is forced downwardly in use by fluid pressure within the cylinder 13 the degree of overlap between the slots 19 and the groove 20 increases and accordingly, for a given applied pressure, the flow rate through the tool will increase. Thus, movement of the piston 14 downwardly (to effect movement of the blades as described below) will result in an increased flow rate through the tool thereby indicating that the blades have moved from their normal retracted position to their extended use position.

The piston 14 engages the blades via a cam member 23 which is secured to the lower end of the piston 14 by a pin 24. The arrangement of the cam member 23 and the blades 5A,5B is substantially the same as the arrangement of the cam member 25 and the blades 6A,6B of the lower reaming stage. Reference should accordingly be had to FIG. 2C which illustrates in more detail the arrangement of the cam member 25 and the lower blades 6A and 6B.

The blades 5A,5B and 6A,6B are pivotally mounted within respective slots 3,4 by means of pivot pins 8 which extends through and are secured to the body 2. The blades 5A,5B and 6A,6B are acted on by respective common torsion springs which tend to maintain the blades in the configuration illustrated in FIG. 2. In this configuration, cam surfaces 26 at the upper extremities of the blades are presented to the lower faces 27 of the cam member 23,25. Downward movement of the cam members will force the blade 6B to rotate clockwise as viewed in FIG. 2C and will simultaneously force the blade 6A to rotate anti-clockwise as viewed in FIG. 2C. Continued downward movement of the cam member 25 will produce continued rotation of the blades 6A,6B until they assume the configuration illustrated in FIG. 5.

Figure 5:
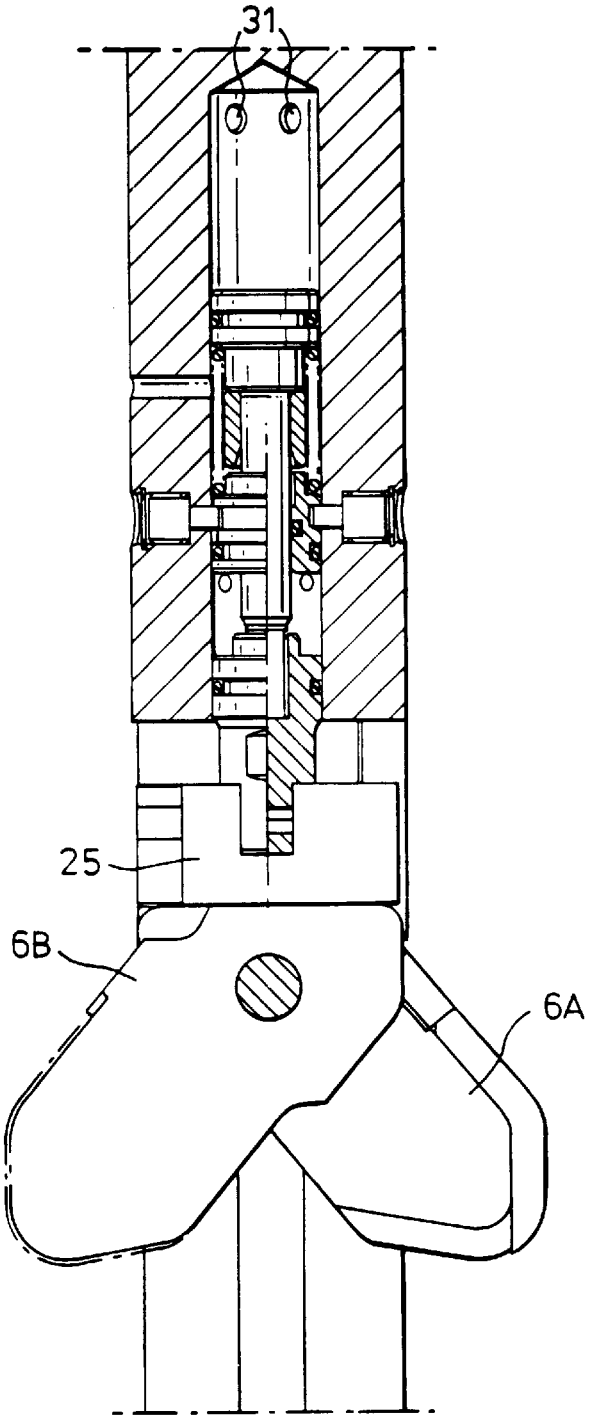
FIG. 5 is a view substantially of the portion of the tool illustrated in FIG. 2C, but with the blades in the fully extended position.
Figure 2C:
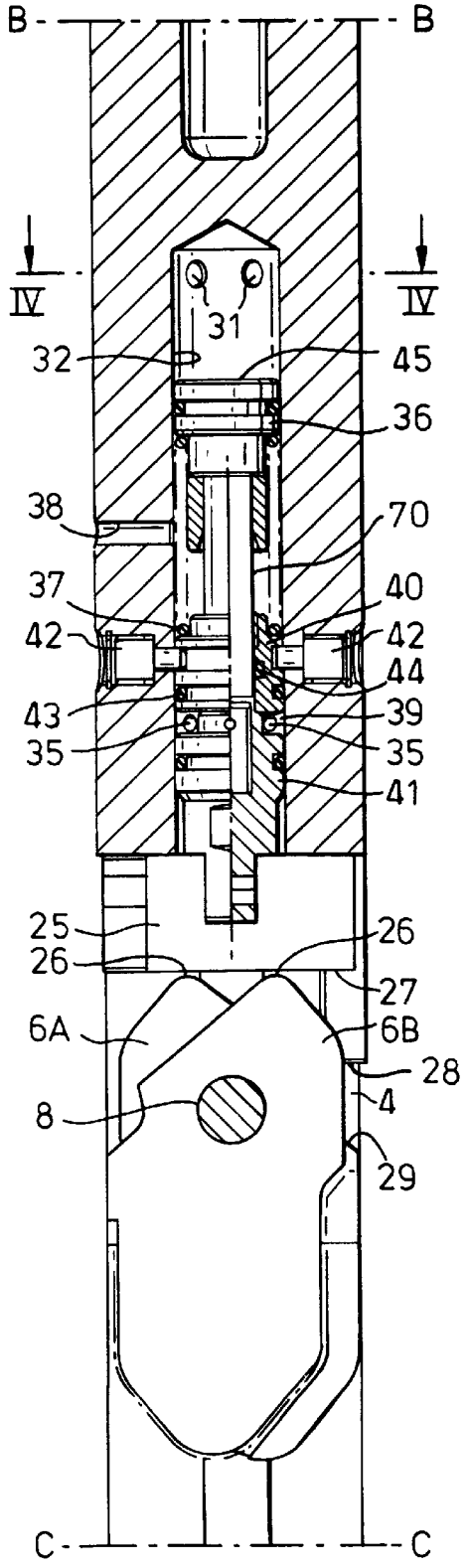
FIG. 2C illustrates a portion of an embodiment of the present invention from the plane B—B of FIG. 2B to the plane C—C.

Preferably, a stop shoulder 28 is provided on the body 2 for each blade 6A,6B (only the stop shoulder 28 for the blade 6A is illustrated in FIG. 2C) to be engaged by respective corresponding shoulders 29 on the blades when the blades are in the fully extended position as illustrated in FIG. 5.

Figure 3:
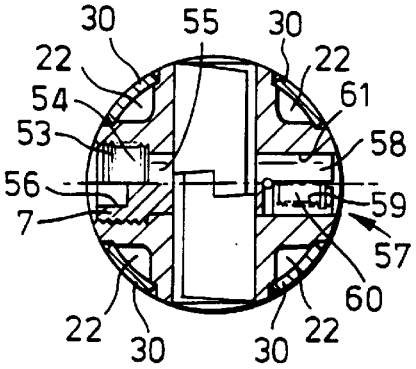
FIG. 3 is a schematic cross-sectional view on the line III—III of FIG. 2B.

Referring now to FIG. 3 it will be noted that the flow passages 22 are provided by machining appropriate grooves in the outer surface of the body 2 and then closing the machined grooves by means of cover plates 30 which are welded in position. By this means, flow passages can be established from the groove 20 to passages 31 (FIG. 2C) which extend radially inwardly from the passages 22 to a central cylinder 32 formed in the body 2. The passages 22 continue downwardly of the tool beyond the passages 31, past the blades 6A,6B and terminate close to the lower end of the tool. A radially extending slots 33 extend from the lower end of each passage 22 into the interior bore 34 of the body adjacent the lower end thereof. Intermediate the passages 31 and the passages 33 a further set of passages 35 (FIG. 2C) extend radially inwardly from the passages 22 to the bore 32.

The passages 31 allow fluid pressure from the passages 22 to be communicated to the cylinder 32 to act on the full circular cross-sectional area of the upper face 45 of the lower piston 36. Fluid pressure acting on the piston 36 produces a downward force on the cam member 25 to shift the blades 6A,6B as described above. A spring 37 is provided to act on the piston 36 to bias the piston 36 into its upper position (corresponding to retraction of the blades) in the absence of fluid pressure within the cylinder 32. The space in which the spring 37 is housed is vented to the exterior of the tool via a vent passage 38.

Fluid pressure from the passages 22 is admitted via the passages 35 to an annular chamber 39 located between a sleeve 40 and an annular portion 41 of the piston 36. The annular piston portion 41 is connected to the upper face portion 45 by means of a rod 70. The sleeve 40 is fixed relative to the body 2 by means of pins 42 and is sealed to the bore of the body by an O-ring 43 and to the piston by an O-ring 44. Pressure in the chamber 39 acts over the annular area of the piston portion 41 to provide a force which supplements that produced by pressure acting over the full circular area of the upper face 45 of the piston.

Figure 2D:
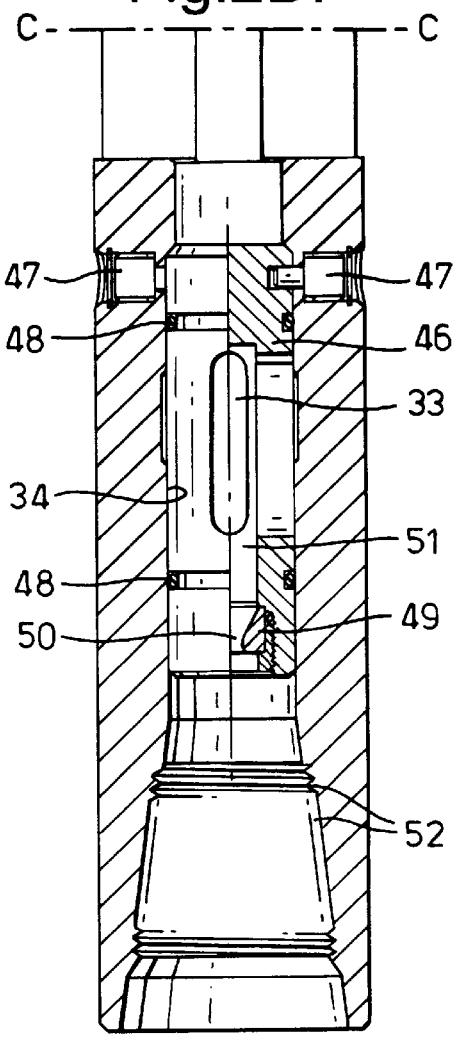
FIG. 2D illustrates a portion of an embodiment of the present invention from the plane CC of FIG. 2C to the bottom end thereof.
Figure 4:
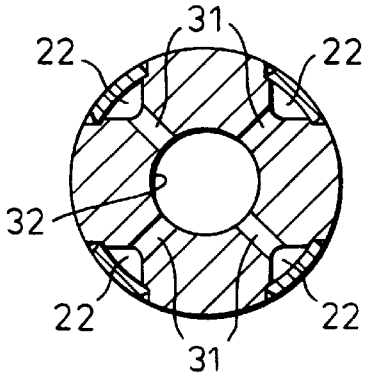
FIG. 4 is a cross-section on the line IV—IV of FIG. 2C.

Referring now to FIG. 2D the lower end of the tool is fitted with a plug 46 which is secured to the body by means of pins 47. An O-ring 48 seals between the plug 46 and the bore 34 of the body to close the bore 34 at the upper end of the plug 46. The lower end of the plug 46 is fitted with a nozzle 49 to provide a restricted outlet 50 from the chamber 51 into which the passages 33 discharge. In use, when fluid is pumped downwardly through the tool from a suitable source the nozzle 50 restricts outward flow of the fluid and thereby provides a back pressure to effect movement of the pistons as described above. The lower extremity of the body 2 is provided with a screw-thread connection 52 enabling the tool to be connected to other components located therebelow.

The pivot pins 7,8 which rotatably mount the blades 5A,5B and 6A,6B respectively are substantially identical. The pivot pin 7 is shown in more detail in FIG. 3 and comprises a body 53 having a head portion 54 and a shaft portion 55. The head portion 54 includes a drive socket 56 to enable a tool to be applied to the pin for the purpose of rotating the pin during insertion and removal thereof. The exterior surface of the head portion 54 is formed with screw-threads which engage mating screw-threads provided in the body 2.

The end of the shaft 55 remote from the head 54 is formed with a locking arrangement 57 to prevent accidental loosening of the pin. In the illustrated locking arrangement the end of the pin is split longitudinally to form a multiplicity, for example four, individual fingers 58. The pin end is also counterbored and threaded so that the fingers 58 define a threaded socket 59.

In one embodiment of pin the exterior of the fingers 58 lie on a circular cylinder which is an extension of the cylindrical profile of the main part of the shaft 55. In this case,the socket 59 is formed with an NPT tapered thread. After the pin 7 has been screwed home by use of a suitable tool an NPT tapered plug 60 is screwed into the threaded socket 59 and, by virtue of the cooperating tapered threads, expands the fingers 58 into tight locking engagement with the wall 61 of the bore in which the pin is located.

In an alternative arrangement, the fingers 58 splay outwardly somewhat from the base of the fingers—i.e. the exterior surfaces of the fingers lie on a cone which diverges away from the head 54. The wall 61 of the pin receiving bore tapers at a mating angle so that when the pin is in position the exterior of the fingers 58 lie against the corresponding tapered portion of the wall 61. In this case, the end of the pin is formed with a parallel threaded socket into which an appropriate locking screw is inserted after the pin has been fully screwed home in order to prevent radially inward movement of the fingers and thereby prevent accidental loosening of the pin. In a particularly preferred embodiment of the invention the locking screw is of a relatively soft metal, for example brass, and is somewhat oversized relative to the screw-thread provided in the socket. Accordingly, as the screw is driven home the socket in the pin will act as a die to cut a tight thread on the screw.

Regardless of whether the pins have a generally parallel exterior surface which is cammed outwardly by an NPT taper screw or whether they have a tapered exterior surface which is locked by a parallel screw, a groove is preferably provided adjacent the mouth of the socket 59 to receive a circlip which will prevent accidental slackening of the locking screw. Thus, in both cases, the pin is locked tight in position by means of a screw which itself is prevented from accidental backing off by a circlip located within a groove formed at the mouth of the screw-threaded socket 59.

It should be noted that the body 2 is, as illustrated in the drawings, unitary. In order to assist manufacture the body may be fabricated from several parts, but these parts are preferably permanently joined together (as by welding) to form the unitary structure described above. The upper piston 14 and its associated seals together with the spring 17 are loaded into the bore of the tool via the open upper end of the body 2 before the adapter 9 is connected. The components of the lower piston assembly are inserted via the lower end of the tool before the closure plug 46 is positioned.

Figure 6:
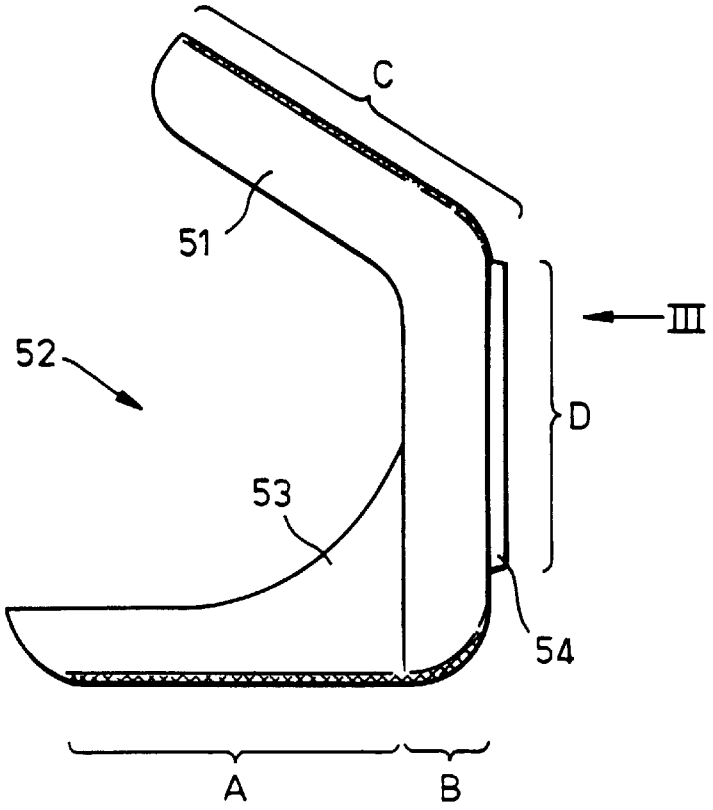
FIG. 6 illustrates schematically a wear resistant member for use in forming a blade for use in a tool in accordance with the present invention.
Figure 7:
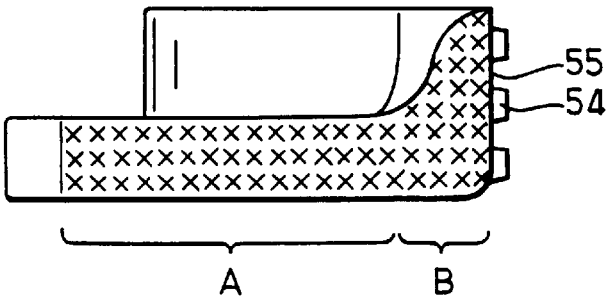
FIG. 7 is a bottom plane view of the wear resistant member of FIG. 6.
Figure 8:
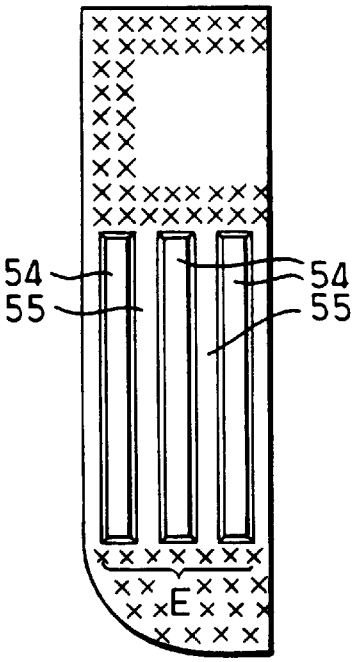
FIG. 8 is a view in the direction of the arrow VIII of FIG. 6.

The blades 5A,5B and 6A,6B preferably comprise bodies of alloy steel having secured thereto one or more wear resistant assemblies of diamond and/or tungsten carbide. The diamond/tungsten carbide material may be secured direct to the steel bodies of the blades but, in a preferred embodiment, the diamond/tungsten carbide members are themselves secured to a base e.g. of a tungsten nickel cobalt matrix which is itself then secured to a steel base arm as by braising. One possible embodiment of wear resistant member for securing to a base in order to form a blade suitable for use in an embodiment of the present invention is illustrated in FIGS. 6–8. The illustrated member comprises a body 51 of a tungsten nickel cobalt matrix having embedded therein hard and wear resistant materials in the critical zones A,B,C and D. In use, the body 51 is secured as by brazing to a steel base arm in order to form a blade assembly for use in an embodiment of the present invention.

Referring to FIG. 6 it will be noted that the wear resistant member 52 is generally C-shaped to present a lower drilling face A which, during downward movement of the tool will act to drill material contacted by the drilling face A; a back reaming face C which, during upward movement of the tool will ream material coming into contact with the back reaming face C; a gauge face D to maintain the gauge diameter of the hole through which the tool passes-and a transition face B which connects the drilling face A to the gauge face D and is effective to remove material close to the gauge diameter during downward drilling with the tool.

The body 52 is substantially C-shaped and underlies the hardwearing material in all the above described zones. The profile of the body 51 is designed to mate with the steel base arm and to provide satisfactory surfaces for brazing. In addition, the body 51 includes any necessary reinforcing, e.g. in the form of a web 53 to prevent thermal distortion of the body during manufacturing.

The zones A,B,C and D are provided with appropriate wear resistant materials designed to optimize the particular functions which the surfaces in use perform. In the-illustrated embodiment of the invention zone A, the drilling face, is set with diamonds regularly spaced and offset to give full area coverage as the tool rotates. The transition zone B is also set with diamonds regularly spaced and off-set to give full coverage, but these diamonds are longer in relation to diameter to give better bonding and/or wear life. For example, the diamonds in the transition zone B may have a length to diameter ratio of 2:1. In location C, the back reaming face, the surface is set with diamonds regularly spaced and off-set to give complete coverage. These diamonds need not be set as densely as in locations A and B as, under normal conditions, the back reaming face encounters less arduous conditions than the drilling face or the transition zone. The gauge face is provided with elongate bars 54 of suitable material, for example thermally stable polycrystalline diamond or tungsten carbide. The bars are set proud of the gauge face to ensure a cutting or cleaning action and the bars are spaced apart by slots 55 to allow material removed by the bars to be cleared from the cutting faces of the bars by drilling mud flowing upwardly past the tool. At the lower edge of the bars 54 the surfaces thereof taper to blend into the radius of the transition face B. Preferably, in transverse cross-section the bars 54 are of a dovetail shape in order to assist bonding of the bars to the body 51.

It should be understood that references herein to "diamond" include natural diamond materials, thermally stable diamond materials and polycrystalline diamond materials and that references to wear resistant material include diamond materials, tungsten carbide and other hard abrasion resistant materials.

The above described wear resistant member may conveniently be formed by a moulding process in which a mould is formed from carbon to provide the desired profile for the wear resistant member.

Figure 9:
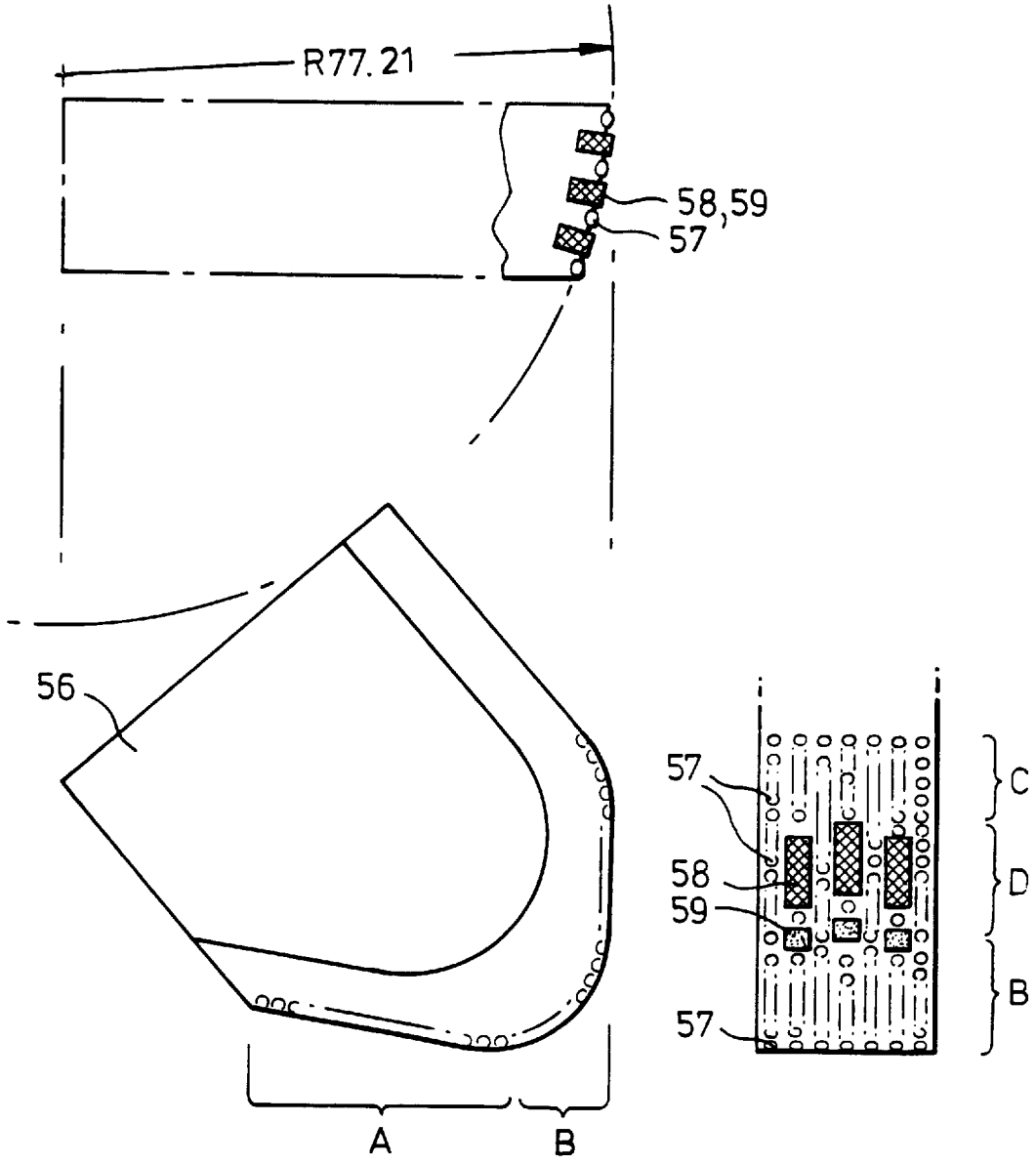
FIG. 9 illustrates our alternative wear resistant member.

Referring now to FIG. 9, an alternative wear resistant member 56 is illustrated. The alternative wear resistant member exhibits the same general zones A,B,C and D as the wear resistant member 52 illustrated in FIGS. 6–8. The zones A,B and C are provided with natural diamond inserts 57 which are suitably spaced and offset to give full area coverage as the tool rotates. The diamonds in the transition zone B may have the preferred length: diameter ratio 2:1 as with the inserts of the arrangements of FIGS. 6–8. In the gauge face D tungsten carbide inserts 58 in the form of rectangular blocks are provided to ensure wear resistance in the gauge area. The tungsten carbide inserts 58 alternate with rows of natural diamond inserts 57 in the gauge face D. Both tungsten carbide inserts 58 and diamond inserts 57 in the gauge face D are set proud of the metal in which they are embedded to provide raised cutting and wear resistant surfaces. At the lower end of each tungsten carbide insert 58 in the region of the junction between the gauge face D and the transition face B thermally stable diamond inserts 59 are provided.

It will be appreciated that whilst FIGS. 6–8 and FIG. 9 provide alternative arrangements for wear resistant members, many other arrangements are possible. In general, combinations of tungsten carbide and diamond are used to provide optimum wear resisting characteristics, and in particular, in the gauge face D the inserts are arranged proud of the material in which they are embedded to provide optimum cutting action and wear resistance.

Whilst the wear resistant blades described above is particularly suitable for use in the 2-stage underreamer described it will be appreciated that the blade arrangement may have alternative uses and, in particular, may be used in downhole tools other than 2-stage underreamers.

We claim:

1. A 2-stage underreamer comprising an upper pair of reaming blades arranged in a slot or pocket in a body and a lower pair of reaming blades arranged in a slot or pocket in the body, the body being unitary and the blades being hingedly mounted on the body and moveable by power means from a retracted storage position to an extended use position wherein at least one pair of blades is moveable from the retracted storage position to the extended use position by power means comprising a hydraulically actuated piston incorporating a first piston portion having a circular face on which hydraulic fluid acts to generate a force and a second piston portion which is annular and upon which hydraulic fluid acts to create a force reinforcing that produced by the hydraulic fluid acting on the first piston portion.

2. An underreamer according to claim 1 wherein the first piston portion is connected to the second piston portion by a rod which passes through an annular member which sealingly engages the rod and a bore provided in the body and separates a fluid chamber which is bounded on one side by the second piston portion from a zone of the bore of the body which is vented to the exterior of the body.

3. An underreamer according to claim 1 wherein separate power means are provided for the upper and lower blades respectively.

4. An underreamer according to claim 3 wherein the power means are hydraulically operated and hydraulic passages extend past the upper blades to provide hydraulic power to the power means associated with the lower blades.

5. An underreamer according to claim 1, wherein the upper blades are moveable from the retracted storage position to the extended use position by movement in respective first and second mutually parallel planes, and wherein the lower blades are moveable from the retracted storage position to the extended use position by movement in the respective third and fourth mutually parallel planes, the third and fourth planes being perpendicular to the first and second planes.

6. An underreamer according to claim 1, wherein spring biasing means are provided for biasing the blades from their extended position towards their retracted positions so that if the power means fails then the blades will be retracted under the influence of the spring biasing means.

7. An underreamer according to claim 1, wherein means are provided for indicating when at least one of the sets of blades has moved from its retracted to its extended position, such means preferably comprising a flow passage through the tool for hydraulic fluid the cross-sectional area of which changes when one of the sets of blades moves from its retracted to its extended position, thereby providing an indication by way of the fluid flow rate through the tool that the blades have moved from their retracted to their extended position.

8. A reaming tool for use in a subterranean wellbore, the tool comprising a body and at least one blade moveable relative to the body between a storage position in which the or each blade is located when the tool is run into the well and a use position in which the or each blade extends from the body, the or each blade comprising an arm of steel and a multiplicity of wear resistant assemblies secured to the arm, wherein the wear resistant assemblies are provided on a gauge face and on an adjacent cutting face of the or each blade, the multiplicity of wear resistant assemblies being secured to the arm as an integral unitary member by means of a single base component in which the multiplicity of wear resistant assemblies is embedded, the base component being secured to the arm by welding or brazing.

9. A tool according to claim 8 wherein the wear resistant assemblies provided on the gauge face are set proud of said face.

10. A tool according to claim 9 wherein the wear resistant assemblies provided on the gauge face are spaced apart from one another so as to provide a path for fluid flowing past the tool when in use.

11. A tool according to claim 10 wherein the cutting face is arranged so as to lie in a plane substantially perpendicular to the longitudinal axis of the wellbore when the respective blade is in the use position.

12. A tool according to claim 8 wherein the wear resistant assemblies on the cutting face are diamond inserts.

13. A tool according to claim 8 wherein the nature and/or packing density of the wear resistant assemblies varies according to their position on the base component.

14. A tool according to claim 8 wherein the base component is of a tungsten nickel cobalt matrix.

15. A tool according to claim 10 wherein the wear resistant assemblies provided on the gauge face are elongated bars of diamond or tungsten carbide.

* * * * *